US006167667B1

(12) United States Patent
Balaban

(10) Patent No.: US 6,167,667 B1
(45) Date of Patent: Jan. 2, 2001

(54) EXPANSION JOINT COVER

(76) Inventor: Petru Balaban, 3621 W. Earll Dr., Phoenix, AZ (US) 85019

( * ) Notice: Under 35 U.S.C. 154(b), the term of this patent shall be extended for 0 days.

(21) Appl. No.: 09/238,596

(22) Filed: Jan. 28, 1999

(51) Int. Cl.[7] ..... E04B 1/66

(52) U.S. Cl. ..... 52/395; 52/393; 52/396.05; 52/459; 52/466; 403/408.1; 403/29

(58) Field of Search ..... 52/395, 393, 396.05, 52/402, 459, 463, 466, 468, 469; 403/408.1, 29, 28, 30

(56) References Cited

U.S. PATENT DOCUMENTS

| | | | | |
|---|---|---|---|---|
| 2,764,788 | * | 10/1956 | Macormack | 52/468 |
| 3,029,912 | * | 4/1962 | Barker | 403/408.1 X |
| 3,844,087 | * | 10/1974 | Shultz et al. | 52/463 |
| 4,029,426 | * | 6/1977 | Sims, Jr. | 403/408.1 |
| 4,100,962 | * | 7/1978 | Housman | 403/30 X |
| 4,394,096 | * | 7/1983 | Stevens | 403/408.1 |
| 4,540,304 | * | 9/1985 | Pavelka et al. | 403/28 X |
| 5,135,341 | * | 8/1992 | Leyder | 403/408.1 X |
| 5,386,676 | * | 2/1995 | Kidaloski et al. | 403/28 X |
| 5,412,917 | * | 5/1995 | Shelton | 52/393 X |
| 5,609,000 | * | 3/1997 | Niese | 52/393 X |

* cited by examiner

*Primary Examiner*—Carl D. Friedman
*Assistant Examiner*—Phi Dieu Tran A

(57) ABSTRACT

A expansion joint cover for covering the top or exposed side of an expansion joint in a structure. The expansion joint cover includes a plate having top and bottom faces, and a pair of sides. The plate also has a plurality of spaced apart fastening holes therethrough extending between the top and bottom faces of the plate. Each fastening hole comprises upper and lower portions. The outer diameter of the upper portion of each fastening hole is greater than the outer diameter of the associated lower portion of the respective fastening hole such that each fastening bore has an annular shoulder formed between the upper and lower portions of the respective hole.

9 Claims, 2 Drawing Sheets

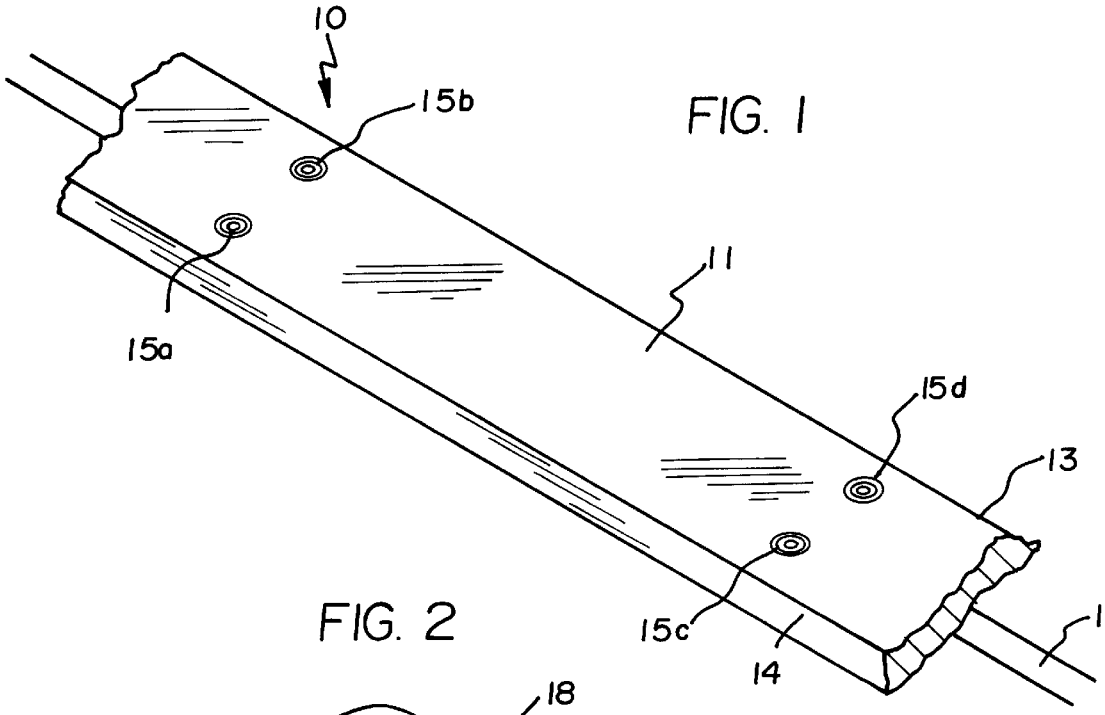
FIG. 1
FIG. 2
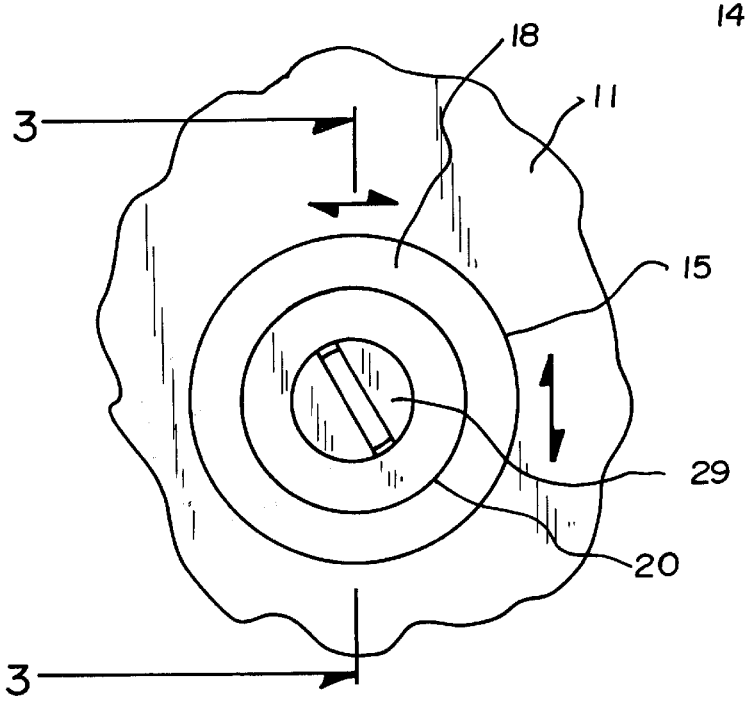

EXPANSION JOINT COVER

BACKGROUND OF THE INVENTION

1. Field of the Invention

The present invention relates to covers for expansion joints and more particularly pertains to a new expansion joint cover for covering the top or exposed side of an expansion joint in a structure.

2. Description of the Prior Art

The use of covers for expansion joints is known in the prior art. More specifically, covers for expansion joints heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,948,994 by Thom; U.S. Pat. No. 4,271,650 by Lynn-Jones; U.S. Pat. No. 3,659,390 by Balzer et al.; U.S. Pat. No. 4,295,315 by Lynn-Jones et al.; U.S. Pat. No. Balzer et al.; and U.S. Pat. No. Des. 261,553 by Chambers.

While these devices fulfill their respective, particular objectives and requirements, the aforementioned patents do not disclose a new expansion joint cover. The inventive device includes a plate having top and bottom faces, and a pair of sides. The plate also has a plurality of spaced apart fastening holes therethrough extending between the top and bottom faces of the plate. Each fastening hole comprises upper and lower portions. The outer diameter of the upper portion of each fastening hole is greater than the outer diameter of the associated lower portion of the respective fastening hole such that each fastening bore has an annular shoulder formed between the upper and lower portions of the respective hole.

In these respects, the expansion joint cover according to the present invention substantially departs from the conventional concepts and designs of the prior art, and in so doing provides an apparatus primarily developed for the purpose of covering the top or exposed side of an expansion joint in a structure.

SUMMARY OF THE INVENTION

In view of the foregoing disadvantages inherent in the known types of covers for expansion joints now present in the prior art, the present invention provides a new expansion joint cover construction wherein the same can be utilized for covering the top or exposed side of an expansion joint in a structure.

The general purpose of the present invention, which will be described subsequently in greater detail, is to provide a new expansion joint cover apparatus and method which has many of the advantages of the covers for expansion joints mentioned heretofore and many novel features that result in a new expansion joint cover which is not anticipated, rendered obvious, suggested, or even implied by any of the prior art covers for expansion joints, either alone or in any combination thereof.

To attain this, the present invention generally comprises a plate having top and bottom faces, and a pair of sides. The plate also has a plurality of spaced apart fastening holes therethrough extending between the top and bottom faces of the plate. Each fastening hole comprises upper and lower portions. The outer diameter of the upper portion of each fastening hole is greater than the outer diameter of the associated lower portion of the respective fastening hole such that each fastening bore has an annular shoulder formed between the upper and lower portions of the respective hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new expansion joint cover apparatus and method which has many of the advantages of the covers for expansion joints mentioned heretofore and many novel features that result in a new expansion joint cover which is not anticipated, rendered obvious, suggested, or even implied by any of the prior art covers for expansion joints, either alone or in any combination thereof.

It is another object of the present invention to provide a new expansion joint cover which may be easily and efficiently manufactured and marketed.

It is a further object of the present invention to provide a new expansion joint cover which is of a durable and reliable construction.

An even further object of the present invention is to provide a new expansion joint cover which is susceptible of a low cost of manufacture with regard to both materials and labor, and which accordingly is then susceptible of low prices of sale to the consuming public, thereby making such expansion joint cover economically available to the buying public.

Still yet another object of the present invention is to provide a new expansion joint cover which provides in the apparatuses and methods of the prior art some of the advantages thereof, while simultaneously overcoming some of the disadvantages normally associated therewith.

Still another object of the present invention is to provide a new expansion joint cover for covering the top or exposed side of an expansion joint in a structure.

Yet another object of the present invention is to provide a new expansion joint cover which includes a plate having top and bottom faces, and a pair of sides. The plate also has a plurality of spaced apart fastening holes therethrough extending between the top and bottom faces of the plate. Each fastening hole comprises upper and lower portions. The outer diameter of the upper portion of each fastening hole is greater than the outer diameter of the associated lower portion of the respective fastening hole such that each fastening bore has an annular shoulder formed between the upper and lower portions of the respective hole.

Still yet another object of the present invention is to provide a new expansion joint cover that helps keep the surface of a floor at an expansion joint relatively flat during expansion and contraction of the expansion joint.

Even still another object of the present invention is to provide a new expansion joint cover that helps prevent people from tripping on uneven floor surfaces due to the expansion and contraction of an expansion joint in the floor surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a portion of a new expansion joint cover according to the present invention.

FIG. 2 is a schematic enlarged top view of the region around a fastening hole of the present invention.

DESCRIPTION OF THE PREFERRED EMBODIMENT

Figure 3:
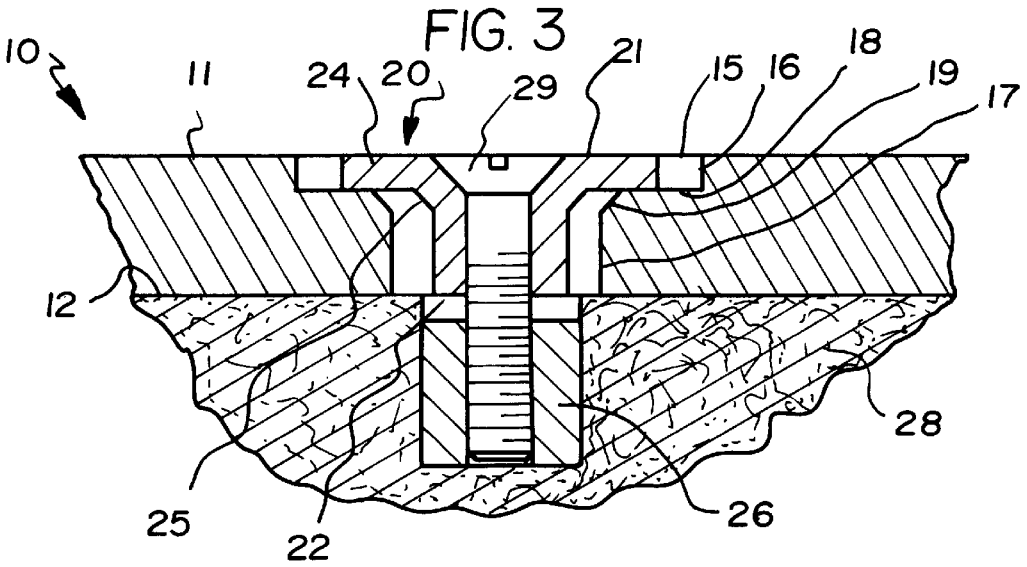
FIG. 3 is a schematic cross sectional view taken from line 3—3 of FIG. 2 of the present invention in use anchored to a floor structure.

With reference now to the drawings, and in particular to FIGS. 1 through 4 thereof, a new expansion joint cover embodying the principles and concepts of the present invention will be described.

As best illustrated in FIGS. 1 through 4, the expansion joint cover generally comprises a plate having top and bottom faces, and a pair of sides. The plate also has a plurality of spaced apart fastening holes therethrough extending between the top and bottom faces of the plate. Each fastening hole comprises upper and lower portions. The outer diameter of the upper portion of each fastening hole is greater than the outer diameter of the associated lower portion of the respective fastening hole such that each fastening bore has an annular shoulder formed between the upper and lower portions of the respective hole.

In use, expansion joint cover is designed for use with a pair of adjacent floor structures each having generally planar upper surfaces. An expansion joint 1 is extended between the floor structures. The expansion joint comprises a resiliently deformable material such as a resiliently deformable rubber material. The expansion joint is designed for permitting expansion and contraction of the floor structures without damaging the adjacent floor structures or excessive separation of the floor structure.

In closer detail, the expansion joint cover comprises a plate 10 having substantially planar top and bottom faces 11,12, and a pair of substantially parallel sides 13,14. Preferably, the top and bottom faces of the plate lie in substantially parallel planes with one another. In an ideal illustrative embodiment, the plate has a thickness defined between the top and bottom faces of the plate of about 5/16 inch. Each of the sides of the plate preferably is beveled such that the sides of the plate lie in planes converging towards one another in a direction towards the top face of the plate. This way, the plate has a generally trapezoidal transverse cross section taken in a plane substantially perpendicular to the lengths of the sides of the plate. The plate has an imaginary midline extending substantially parallel to the sides of the plate. The midline of the plate is generally equidistantly spaced between the sides of the plate. The midline of the plate dividing the plate into a pair of regions with one region adjacent one side of the plate and the other region adjacent the other side of the plate. In use, the plate is positioned over the expansion joint such that the midline of the plate extends generally parallel with the expansion joint and one of the regions of the plate is positioned over one of the floor structures and the other of the regions of the plate is positioned over the other of the floor structures.

The plate has a plurality of spaced apart fastening holes 15*a*,15*b*,15*c*,15*d* therethrough extending between the top and bottom faces of the plate. The plurality of fastening holes of the plate are preferably grouped into a plurality of pairs of the fastening holes. In this preferred embodiment, one fastening hole of each pair of fastening holes is located in a first of the regions of the plate such that the fastening hole is positioned over the associated floor structure adjacent the first region of the plate. The other fastening hole of each pair of fastening holes in this preferred embodiment is located in a second of the regions of the plate such that the fastening hole is positioned over the associated floor structure adjacent the second region of the plate.

As illustrated in FIG. 1, each pair of fastening holes defines a line therebetween extending substantially parallel to the lines of the other pairs of fastening holes and substantially perpendicular to the sides of the plate. Each of the pairs of fastening holes is spaced apart from the other of the pairs of fastening holes. Preferably, the pairs of the fastening holes are arranged in line along the length of the plate in a row extending substantially parallel to the sides of the plate. Ideally, the pairs of fastening holes are spaced apart at generally equal intervals in the row of pairs of fastening holes.

As illustrated in FIG. 3, each fastening hole 15 comprises substantially coaxial generally cylindrical upper and lower portions 16,17. The upper portion of each fastening hole is positioned adjacent the top face of the plate. The lower portion of each fastening hole is positioned adjacent the bottom face of the plate. The upper portion of each fastening hole is substantially coaxial with the associated lower portion of the respective fastening hole.

The upper and lower portions of each fastening hole each have an outer diameter defined in planes substantially parallel to the top and bottom faces of the plate. The outer diameter of the upper portion of each fastening hole is greater than the outer diameter of the associated lower portion of the respective fastening hole such that each fastening bore has an annular shoulder 18 formed between the upper and lower portions of the respective hole. In an ideal illustrative embodiment, the outer diameter of each upper portion is about 1½ inches, and the outer diameter of each lower portion is about 1 inch.

In an ideal embodiment, each fastening hole has an annular beveled region 19 between the annular shoulder and lower portion of the respective fastening hole. Each of the beveled regions flares upwards in a direction towards the top face of the plate. The beveled region of each fastening hole has a slope extending ideally at about 45 degrees from the plane of the bottom face of the plate.

Figure 4:
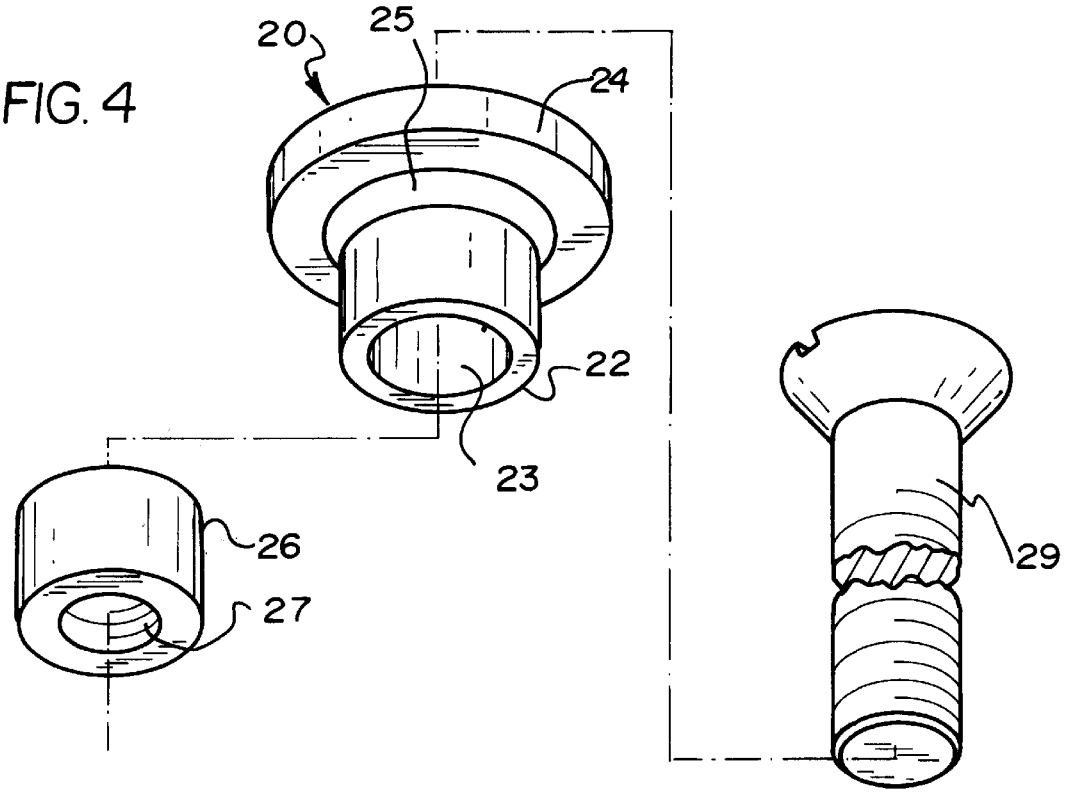
FIG. 4 is a schematic exploded perspective view of an insert, an anchor sleeve, and threaded fastener of the present invention.

A plurality of generally cylindrical tubular inserts 20 are also provided. As illustrated in FIGS. 3 and 4, each insert has opposite upper and lower ends 21,22, an axial bore 23 therethrough extending between the upper and lower ends of the respective insert, and an annular upper flange 24 outwardly radiating from the upper end of the respective insert.

Each insert is associated with a corresponding fastening hole of the plate. Each insert is inserted into the respective corresponding fastening hole. As best illustrated in FIG. 3, the upper end of each insert is positioned in the respective corresponding fastening hole adjacent the top face of the plate. The lower end of each insert is positioned in the respective corresponding fastening hole adjacent the bottom face of the plate. The upper flange of each insert is rested on the annular shoulder of the respective corresponding fastening hole.

Preferably, each insert has a beveled region 25 adjacent the upper flange of the respective insert. The beveled region of each insert is positioned in the respective corresponding fastening hole adjacent beveled region of the respective corresponding fastening hole.

Each insert has an outer diameter less than the outer diameter of the lower portion of the respective corresponding fastening hole. With reference to FIGS. 2 and 3, the upper flange of each insert has an outer diameter less than the outer diameter of the upper portion of the respective corresponding fastening hole and greater than the outer diameter of the lower portion of the respective corresponding fastening hole. In use, this permits the insert to move in the corresponding fastening hole.

With reference to FIGS. 3 and 4, a plurality of generally cylindrical tubular anchor sleeves 26 are also provided each having a threaded lumen 27. Each anchor sleeve is associated with a corresponding fastening hole. As best shown in FIG. 3, the anchor sleeves each preferably have an outer diameter less than the outer diameter of the lower portion of the corresponding fastening hole and greater than the outer diameter of the insert associated with the corresponding fastening hole. In use, each of the anchor sleeves is inserted into a corresponding bore in a the floor structure 28 adjacent the corresponding fastening hole.

The expansion joint cover also includes a plurality of threaded fasteners 29. Each of the threaded fasteners is associated with a corresponding fastening hole. As illustrated in FIG. 3, each threaded fastener is extended through the axial bore of the insert associated with the corresponding fastening hole and threadably inserted into the threaded lumen of the anchor sleeve associated with the corresponding fastening hole to secure the plate to the floor structures while permitting slight movement of the plate in a plane parallel to the floor structures.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An expansion joint cover, comprising:

a plate having top and bottom faces, and a pair of sides;

said plate having a plurality of spaced apart fastening holes therethrough extending between said top and bottom faces of said plate;

each fastening hole comprising upper and lower portions, said upper and lower portions of each fastening hole having an outer diameter, said outer diameter of said upper portion of each fastening hole being greater than said outer diameter of the associated lower portion of the respective fastening hole such that each fastening bore has an annular shoulder formed between said upper and lower portions of the respective holes a plurality of generally cylindrical inserts, each insert having opposite upper and lower ends, an axial bore therethrough extending between said upper and lower ends of the respective insert, an annular upper flange outwardly radiating from said upper end of the respective insert, each insert being associated with a corresponding fastening hole of said plate, each insert being inserted into the respective corresponding fastening hole; and a plurality of generally cylindrical tubular anchor sleeves each having a threaded lumen, each anchor sleeve being associated with a corresponding insert.

2. The expansion joint cover of claim 1, wherein said plate is divided into a pair of regions, wherein said plurality of fastening holes of said plate is grouped into a plurality of pairs of said fastening holes, wherein one fastening hole of each pair of fastening holes is located in a first of said regions of said plate, and wherein the other fastening hole of each pair of fastening holes is located in a second of said regions of said plate.

3. The expansion joint cover of claim 2, wherein each pair of fastening holes defines a line therebetween extending substantially parallel to the lines of the other pairs of fastening holes and substantially perpendicular to said sides of said plate.

4. The expansion joint cover of claim 2, wherein said pairs of said fastening holes are arranged in a row extending substantially parallel to said sides of said plate.

5. The expansion joint cover of claim 4, wherein said pairs of fastening holes are spaced apart at generally equal intervals in said row of pairs of fastening holes.

6. The expansion joint cover of claim 1, wherein said upper end of each insert is positioned in the respective corresponding fastening hole adjacent said top face of said plate, wherein said lower end of each insert is positioned in the respective corresponding fastening hole adjacent said bottom face of said plate, and wherein said upper flange of each insert is rested on said annular shoulder of the respective corresponding fastening hole.

7. The expansion joint cover of claim 1, wherein each insert has a beveled region adjacent said upper flange of the respective insert.

8. The expansion joint cover of claim 1, wherein each insert has an outer diameter less than said outer diameter of said lower portion of the respective corresponding fastening hole, and wherein said upper flange of each insert has an outer diameter less than said outer diameter of said upper portion of the respective corresponding fastening hole and greater than said outer diameter of said lower portion of the respective corresponding fastening hole.

9. An expansion joint cover system, comprising:

a pair of adjacent floor structures each having generally upper surfaces;

an expansion joint being extended between said floor structures, said expansion joint comprising a resiliently deformable material;

a plate having substantially planar top and bottom faces, and a pair of substantially parallel sides;

said top and bottom faces of said plate lying in substantially parallel planes with one another;

each of said sides of said plate being beveled such that said sides of said plate lie in planes converging towards one another in a direction towards said top face of said plate;

said plate having a midline extending substantially parallel to said sides of said plate, said midline of said plate being generally equidistantly spaced between said sides of said plate;

said midline of said plate dividing said plate into a pair of regions;

said plate being positioned over said expansion joint such that said midline of said plate extends generally parallel with said expansion joint and one of said regions of said plate is positioned over one of said floor structures and the other of said regions of said plate is positioned over the other of said floor structures;

said plate having a plurality of spaced apart fastening holes therethrough extending between said top and bottom faces of said plate;

said plurality of fastening holes of said plate being grouped into a plurality of pairs of said fastening holes.

* * * * *